US006962179B1

(12) United States Patent
Brodersen

(10) Patent No.: US 6,962,179 B1
(45) Date of Patent: Nov. 8, 2005

(54) FLOOR JACK

(76) Inventor: Kelvin Craig Brodersen, 4.2 Mile Goldstream, 1912 Kestrel La., Fairbanks, AK (US) 99709-6259

( * ) Notice: Subject to any disclaimer, the term of this patent is extended or adjusted under 35 U.S.C. 154(b) by 0 days.

(21) Appl. No.: 10/672,842

(22) Filed: Sep. 26, 2003

Related U.S. Application Data

(63) Continuation of application No. 10/150,986, filed on May 17, 2002, now abandoned.

(51) Int. Cl.[7] ..... B27H 1/00; B66F 3/00
(52) U.S. Cl. ..... 144/270; 154/11
(58) Field of Search ..... 254/11–17, 120, 254/131; 144/270

(56) References Cited

U.S. PATENT DOCUMENTS

| | | | | |
|---|---|---|---|---|
| 14,676 A | | 4/1856 | Oliver | |
| 81,809 A | | 9/1868 | Mackay | |
| 299,220 A | | 5/1884 | Hatch | |
| 302,418 A | | 7/1884 | Lobdell | |
| 375,147 A | | 12/1887 | Fredericks | |
| 376,439 A | | 1/1888 | Holmes | |
| 460,790 A | | 10/1891 | Marston | |
| 764,128 A | | 7/1904 | Jeffords | |
| 797,245 A | | 8/1905 | Wallum | |
| 975,566 A | | 11/1910 | Norton | |
| 1,231,461 A | | 6/1917 | Torncheck | |
| 1,354,854 A | | 10/1920 | Scutly | |
| 1,618,896 A | | 2/1927 | Tubbs | |
| 2,589,404 A | | 3/1952 | Lab | |
| 2,780,437 A | | 2/1957 | Ham | |
| 3,524,623 A | | 8/1970 | Campbell | |
| 3,779,515 A | | 12/1973 | Larios et al. | |
| 4,290,582 A | * | 9/1981 | Eckelkamp | 254/15 |
| 4,620,691 A | | 11/1986 | Waters, Jr. | |
| 5,139,231 A | * | 8/1992 | Temple | 254/16 |
| 5,248,127 A | | 9/1993 | Young | |
| D353,987 S | | 1/1995 | Pasto | |
| 5,527,014 A | | 6/1996 | Bracewell | |

* cited by examiner

*Primary Examiner*—Derris H. Banks
*Assistant Examiner*—Shelley Self
(74) *Attorney, Agent, or Firm*—George C. Rondeau, Jr.; Davis Wright Tremaine LLP

(57) ABSTRACT

A bending jack for straightening bent boards. The device has three main components: a spur assembly that has a spur head, a spur bar and a spur; a handle, secured to the spur bar by a pivot pin or bolt; and a push arm. At one end of the push arm is a shoe. The other end of the push arm is pivotably attached to the handle. The device is used by driving the spur into a joist near a bent board. The device is set so that the shoe is near the spur and abuts against the board. As the handle is then moved forward it pushes the shoe against the board. Because the spur is fixed in the joist, the board is moved in the direction of the handle movement. Once the board is secured, the device can be pulled from the joist, ready for the next operation.

54 Claims, 13 Drawing Sheets

FLOOR JACK

CROSS-REFERENCE TO RELATED APPLICATION

This application is a continuation of U.S. patent application Ser. No. 10/150,986, filed May 17, 2002, now abandoned.

BACKGROUND OF THE INVENTION

1. Field of the Invention

This invention relates to floor jacks and particularly to floor jacks having a pivot point located before the anchor mechanism.

2. Description of the Related Art

One of the most common problems in laying an outdoor deck or wood floor is that the wooden boards tend to warp. Due to the nature of woodcutting, wood boards often warp in the horizontal plane, forming a flat, curved board. The construction of wood floors and decks is generally based on laying straight runs of boards forming a square or rectangular structure, curved boards present a problem. A simple but inefficient solution is to restrict the usable materials to only straight boards. A more practical solution is to use a means to straighten out the deck boards as they are installed. By anchoring one side of a board in its proper position, it is possible to bend a board back into a straight position, where it can be fastened to the underlying framing to secure it in place. Several devices have been developed over the years to accomplish this task. For example U.S. Pat. No. 14,676 shows a device that clamps to a joist. A long arm extends forward, which is used to contact a given board. A handle extends upward and is pivotable to cause the arm to move forward, pushing against a board, as the handle is depressed. In this way, the board can be straightened. Similar devices are found in U.S. Pat. Nos. 81,803, 299,220, 302,416, 375,147, 376,439, 460,790, 764,128, 797,245, 975,566, 1,231,461, 1,354,854, 2,589,404, 2,780,437, 3,524,623, 3,779,515,4,620,691, 5,248,127, D 353,987, 5,527,014.

All of the above devices use some type of lever action to straighten boards and they all use some type of means to secure the device in place to prevent it from moving. All of them suffer from some problem that makes their use impractical.

There are three main problems with these devices. First, is the type of fastening used to hold the device in place; second, is the leverage system used; and third, is the placement of the pivot point to obtain the leverage. Regarding the type of fastening, there are two main types: clamps and spikes. Clamps are generally placed around joists that lie beneath the floor or deck surface. The clamps are labor intensive to install. Moreover, where access to the joists is limited or restricted, the clamps are useless. Spikes are simpler to install and remove. However, some of the device require such a great deal of holding power (due to their poor leverage as discussed below), they require an excessive number of spikes. Such large number of spikes makes removal of the tool difficult and can do serious damage to the joists. The second problem is the leverage system used. In some of these devices, the devices are long and flat. It appears that some of them can be two feet or more in length. This is a problem when working in tight spaces. Such long machines cannot be used near walls and other obstructions. Finally, most of these devices use a pivot point for the handle that is in front of the fastening mechanism. What this means is that as the handle is activated, it applies a moment force on the tool that pushes the jack portion forward, while simultaneously trying to lift the fastened end up. It is because of this lifting tendency that large clamps and multiple spikes are required for the devices to work at all. In many cases, unless the devices are sufficiently held down, the device merely rotates upward from the back, using the bent board as a fulcrum, instead of operating the other way around.

BRIEF SUMMARY OF THE INVENTION

The instant invention overcomes these problems. It is a bending jack that has one spur or spike for holding it in place and short operational throw and a pivot point located behind the spur. Thus, when the handle is pulled forward, the tendency is to push the spur further into the joist instead of pulling it out. Moreover, because the angle of throw is short, the rotational moment is minimized and most of the force is directed into the board in a horizontal plane.

The device has three main components. The first is a spur assembly. The spur assembly is made of one piece and has a spur head, a spur bar and a spur. At the end of the spur assembly opposite that of the spur is a pivoting handle. The second component is a handle that is secured to the spur bar by a pivot pin or bolt. The third component is a push arm. At the distal end of the push arm is a shoe formed of angle iron or similar material. The proximate end of the push arm is pivotably attached to the handle at a point above that of the spur bar. The push arm is actually two pieces that fit around the spur assembly. Control pins are positioned to limit the amount of travel of the push arm.

The device is used by driving the spur into a joist adjacent to a floor or deck board that needs to be straightened. The handle is held back so that the shoe is near the spur and abuts against the board. The handle is then moved forward, which pushes against the fixed spur. Because the spur is fixed in the joist, the board is moved in the direction of the handle movement, which causes the board to be straightened. Once the board is secured, the device can be pulled from the joist, ready for the next operation.

The key to the success of this invention is that the fulcrum for the handle lies behind the spur, unlike the prior art designs that place the fulcrum either in front of or on top of the spur. With the fulcrum behind the spur, the device remains flat and holds securely when the shoe is straightening the board. The prior art devices have a tendency to lift up from the joist, which makes them impractical to use.

BRIEF DESCRIPTION OF THE SEVERAL VIEWS OF THE DRAWING(S)

DETAILED DESCRIPTION OF THE INVENTION

Referring now to FIGS. 1 and 4–7, the device 1 has three main components. The first component is the spur assembly 2. The second component is the handle 3 and the third component is the push arm and shoe 4.

Figure 4:
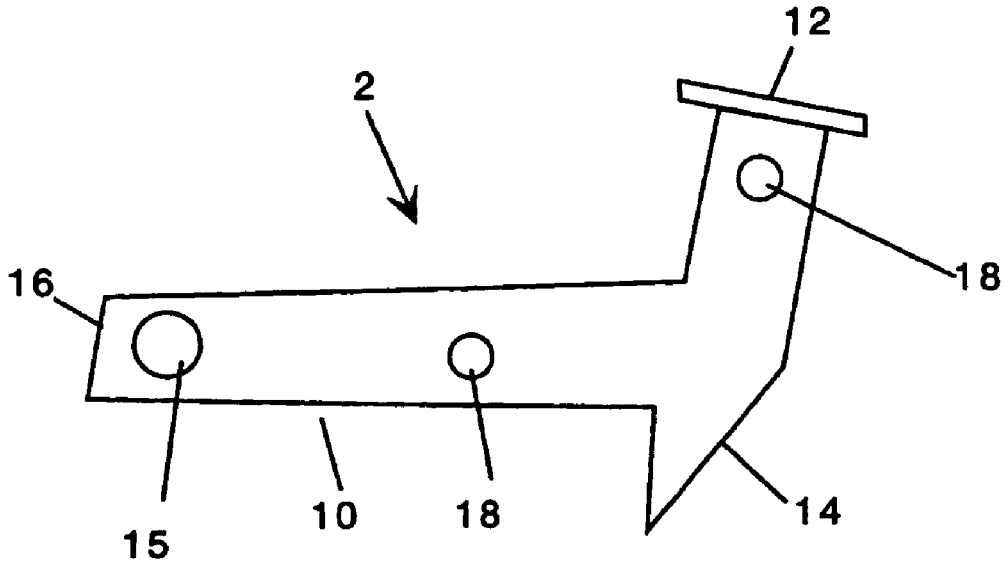
FIG. 4 is a side view of the spur assembly.

FIG. 4 shows a side view of the spur assembly. In the preferred embodiment, the spur assembly 2 is made of one piece of material, preferably steel. The spur assembly has a spur bar 10, a spur head 12 and a driving spur 14. A hole 15 for a pivot point, as discussed below, is provided near the distal end 16 of the spur bar. Two control pins 18 are also provided and are either formed on or fixedly attached to the spur assembly. These pins protrude from the surface of the spur assembly and limit the travel of the push arm. This limitation keeps the device assembled in a rough operating configuration. Without these pins, the push arm and spur bar may become separated and could flop around. Moreover, these parts have to be reassembled for use, which can slow the job down somewhat. The pins keep the parts together, making it ready to use.

Figure 5:
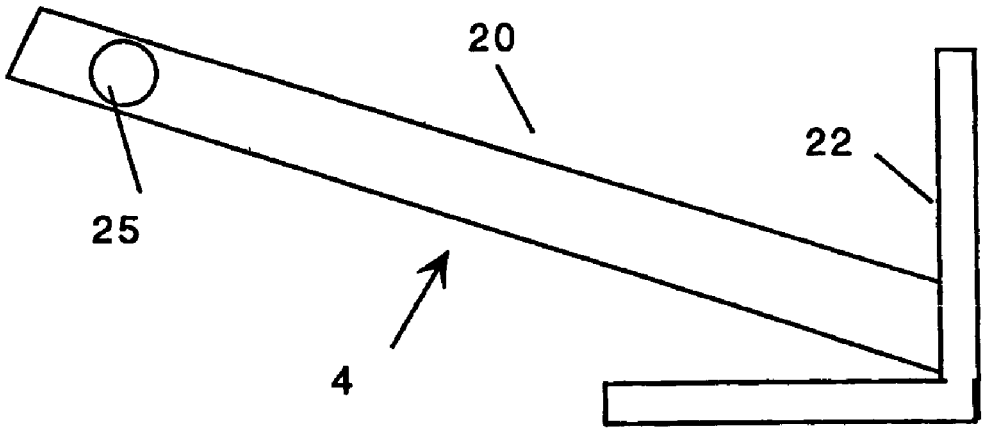
FIG. 5 is a side view of a push arm and shoe.
Figure 6:
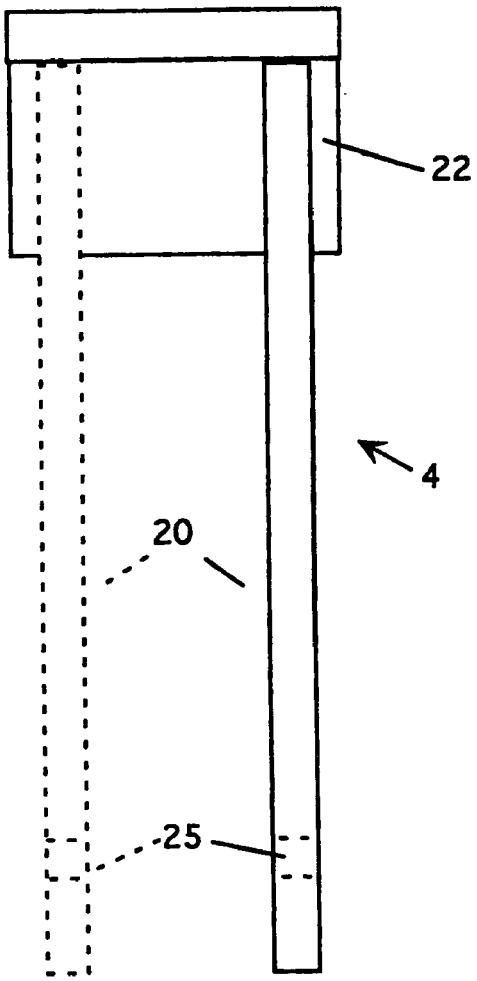
FIG. 6 is a top view of a push arm and shoe.

FIGS. 5 and 6 show side and top views of the push arm-shoe assembly 4. This assembly has a pair of push arms 20 that are welded or otherwise formed on the inner face of a shoe 22. The shoe 22 is an angle piece made of materials common to the art, such as steel. Note that the pair of push arms 20 is attached to the shoe at an angle. This is done to produce maximum transfer of force from the handle during use. A pair of mounting holes 25 is used to attach the push arms to the handle 3.

Figure 1:
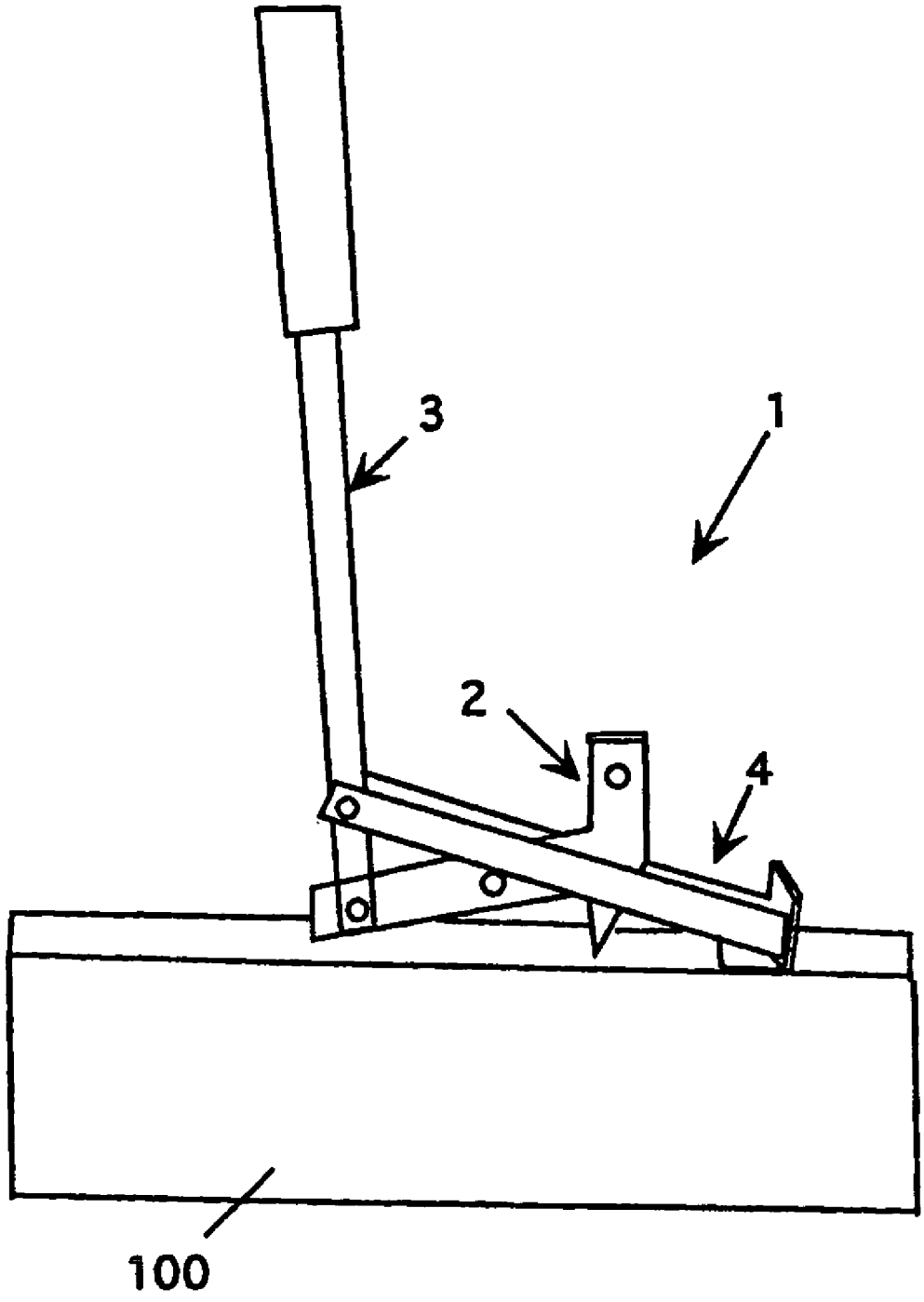
FIG. 1 is a side detail view of the invention in place on a joist with the spur ready to be driven into the joist.
Figure 7:
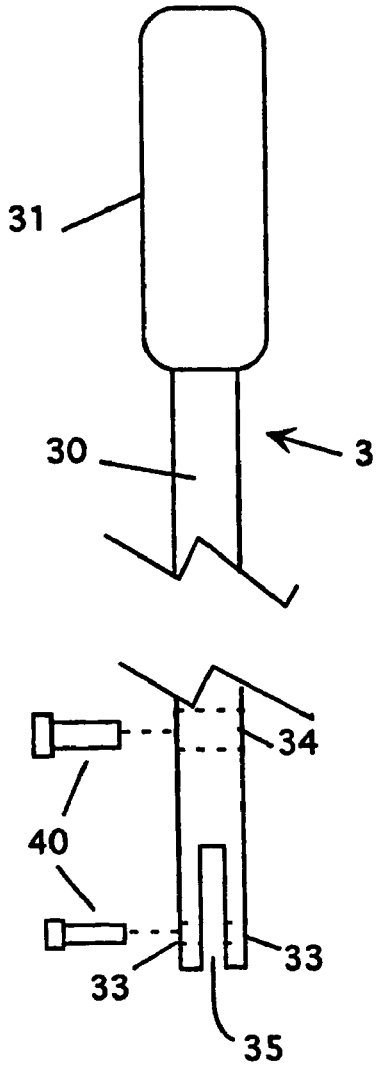
FIG. 7 is a front view of one embodiment of the handle.

Referring now to FIGS. 1 and 7, details of one of the styles of handle 3 are shown. Here, the handle has a long bar 30 that has a padded cap 31 at the top. The base of the handle is bifurcated to receive the spur assembly. Two holes 33 are placed in the bifurcated section 35 of the handle so that the bolt or pin 40 can pass through both the handle and spur bar at hole 15. The bolt or pin 40 is designed to allow the handle 3 to pivot about the spur bar, as discussed below. A third hole 34 is placed above the bifurcated section and is used to secure the push arms to the handle. A bolt or pin 40 that allows the push arms to pivot with the handle is used to secure the handle to the push arms.

Figure 8:
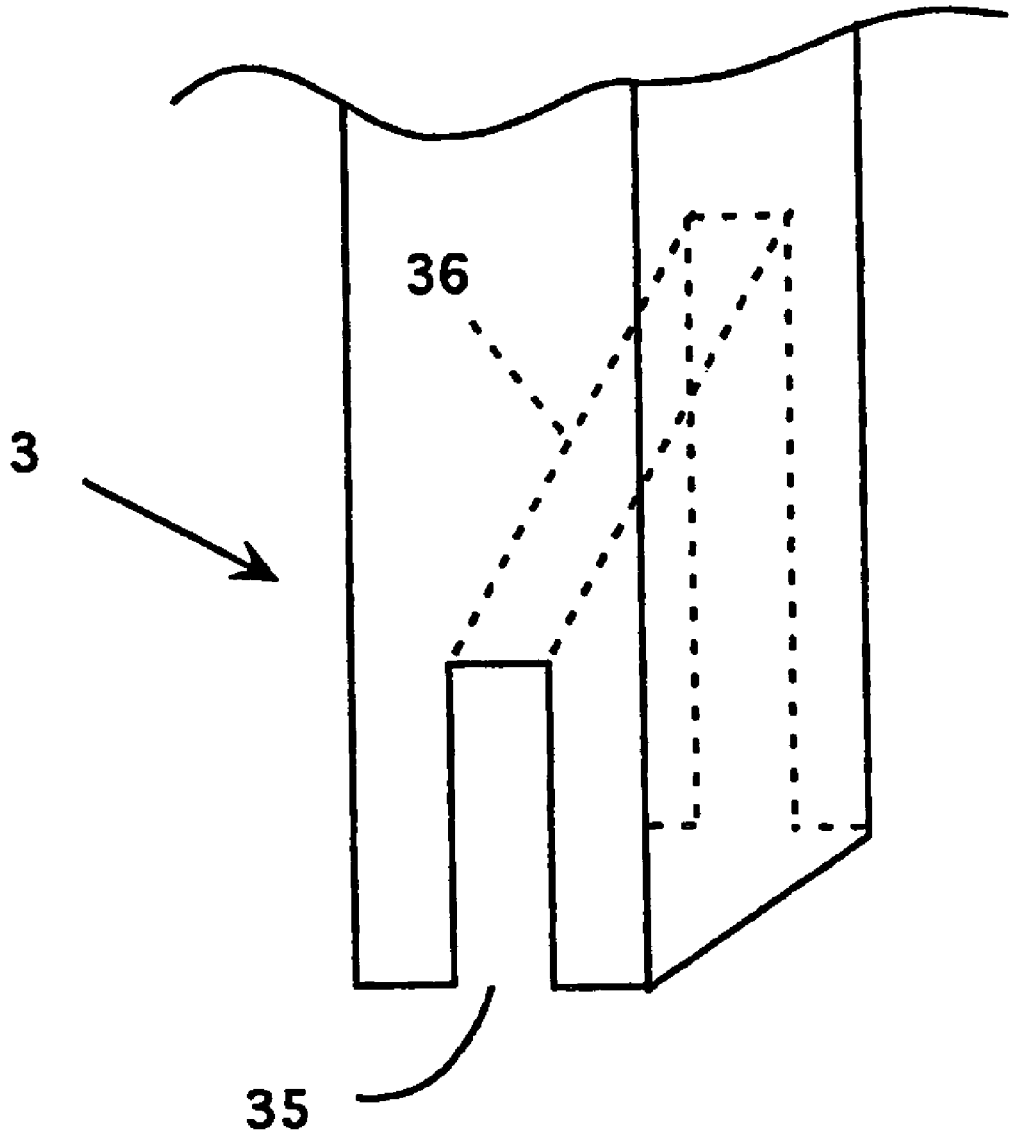
FIG. 8 is a detail of the lower handle of the first embodiment.

FIG. 8 shows the lower portion of this handle 3. The bifurcated section 35 is shown having an angled upper surface 36. The angles upper surface 36 provides clearance for the handle as it moves forward and backward.

Figure 9:
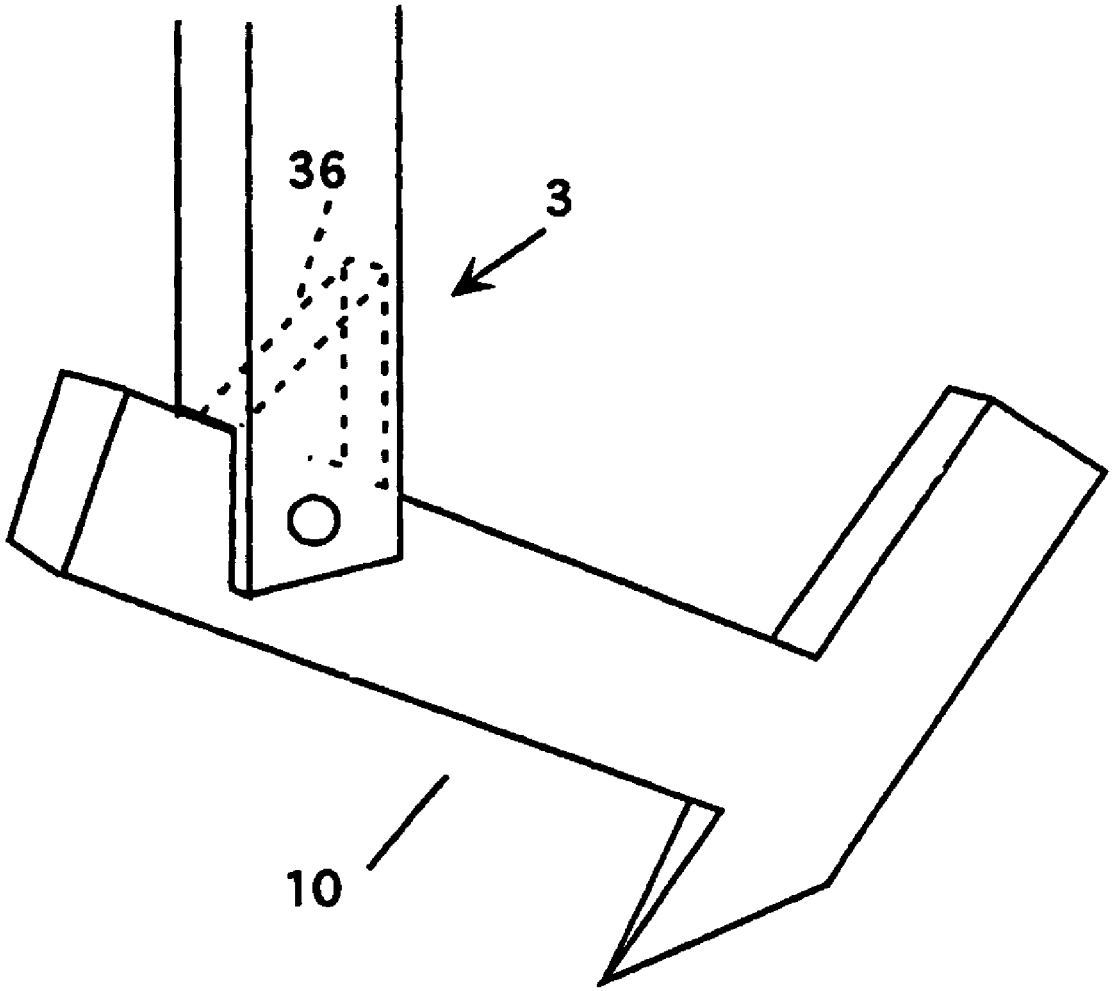
FIG. 9 is a detail showing the handle of FIG. 7 and spur assembly at the rear stop position.

FIG. 9 shows the position of the handle 3 in the rear stop position. The stop positions are used to control the movement, forward and backward, of the handle to allow for movement with limits. In FIG. 9, the rear stop is the back of the spur bar 10. As shown, the handle 3 is moved back until it contacts the rear spur bar 10. Here is where the angles upper surface is used. As shown, the angled upper surface rests on the top of the spur bar 10 when the handle is in the rear stop position.

Figure 10:
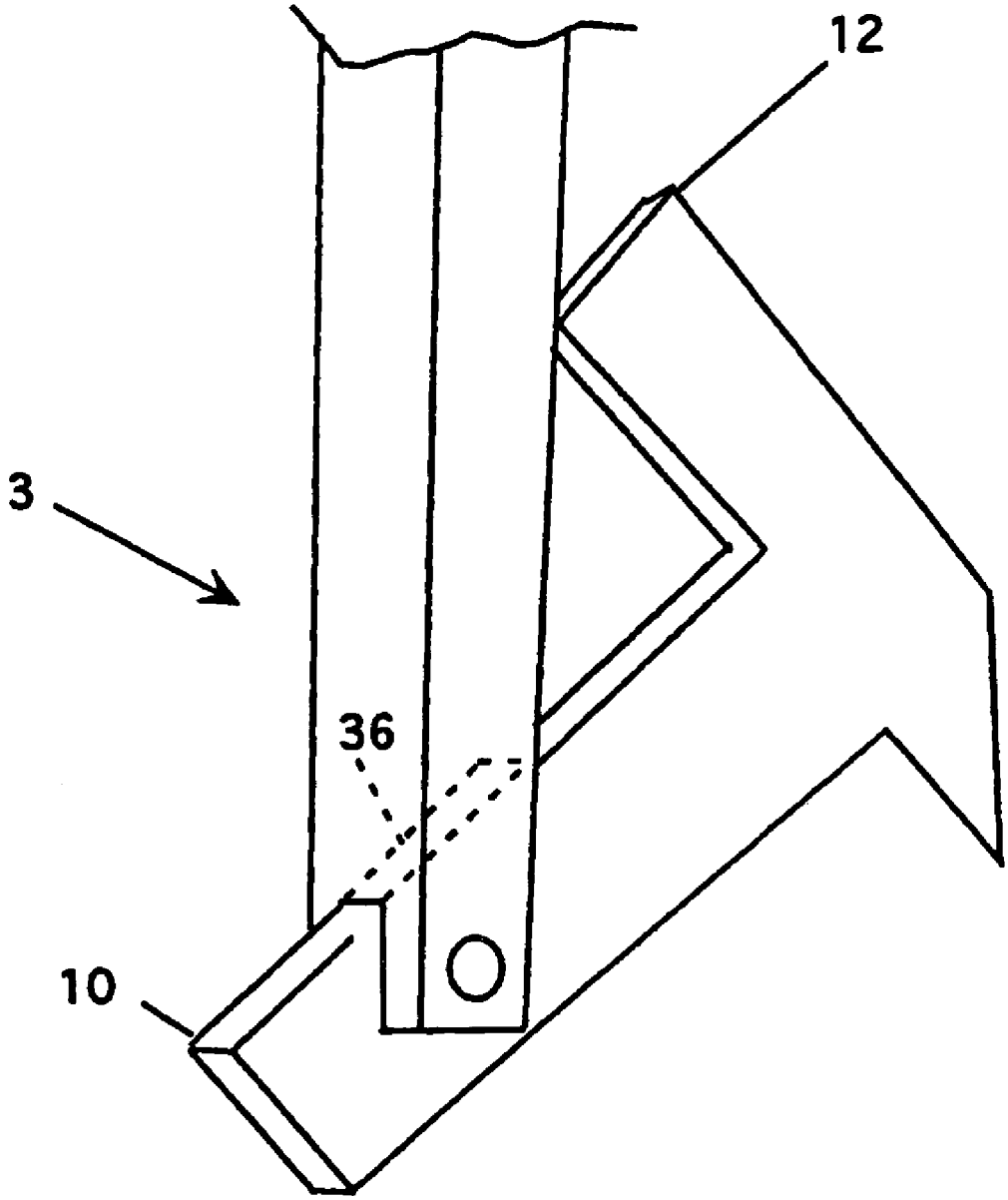
FIG. 10 is a detail showing the handle of FIG. 7 and spur assembly at the front stop position.

FIG. 10 shows the front stop position. Here, the front of the handle 3 contacts the top 12 of the spur bar 10. This is the maximum forward movement possible for the device in one movement. Note that without the angled upper surface 36 of the bifurcated portion 35, the handle 3 would stop earlier in its movement. Of course, one is not required to move the handle to the full forward stop position, if the board needs only slight movement to straighten it.

As discussed below, the stops vary from embodiment to embodiment but work on the same essential principle. These variations are discussed below.

Figure 11:
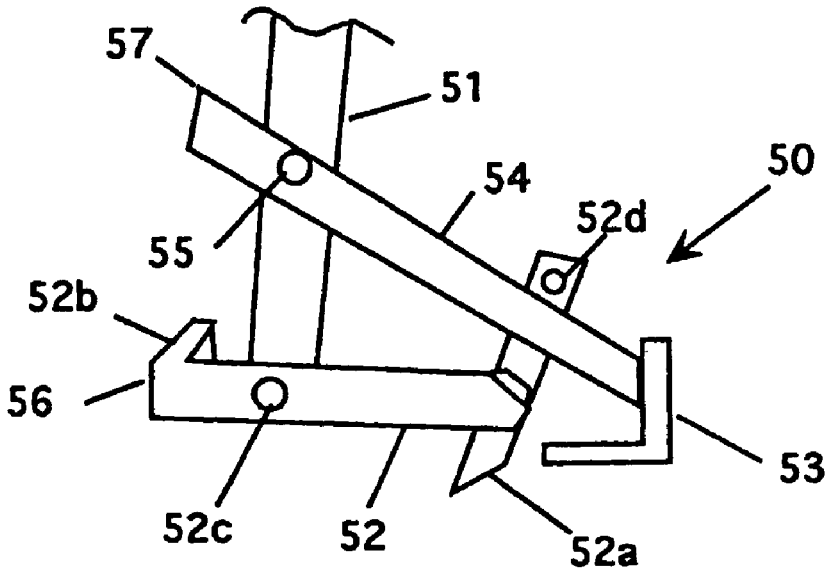
FIG. 11 is a side detail view of a second embodiment of the invention.

FIGS. 11–14 show variations of this basic theme: FIG. 11 shows a second embodiment. In this embodiment, the device 50 has a handle 51 that is not bifurcated at the base as the handle of the first embodiment. The spur bar 52 has a spur 52*a* and a stop 52*b*. The spur bar 52 is attached to the handle by a pivot 52*c* as before. A pin 52*d* can be added to hold the elements together, as discussed above. A shoe 53 is attached to a push arm 54 as before. Here, a pivot 55 attaches the push arm to the handle. In this embodiment, the back 56 of the spur bar 52 is bent back. The bent portion 52*b* acts as a stop to limit the rear movement of the handle. The forward movement of the handle is limited by the head of the spur, as before.

Figure 12:
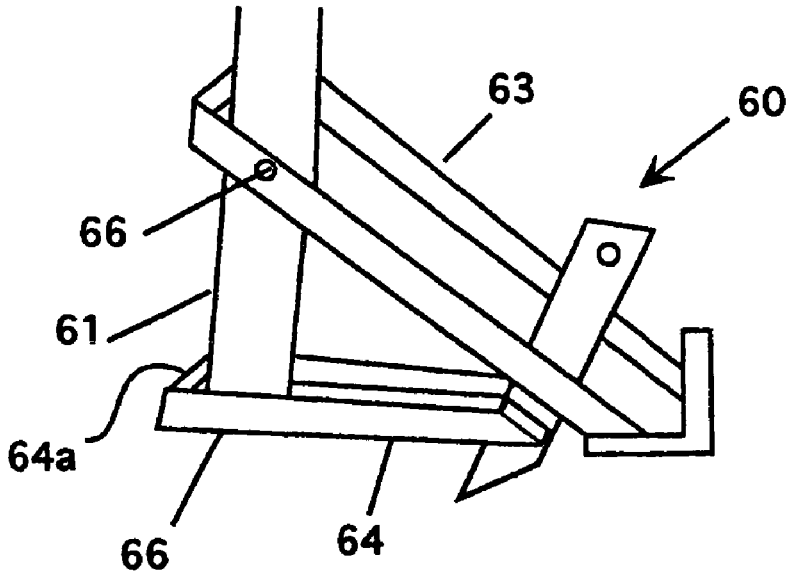
FIG. 12 is a perspective view of a third embodiment.

FIG. 12 shows a third embodiment 60. In this embodiment, the handle 61 is positioned between the push arms 63 and spur bars 64, which are doubled and placed around the handle 61 as shown. Pivot pins or bolts 66 are used to pivot the handle. In this embodiment the rear stop is the curved rear portion 64*a* of the spur bars. The forward stop is the top of the spur 60 as before.

Figure 13:
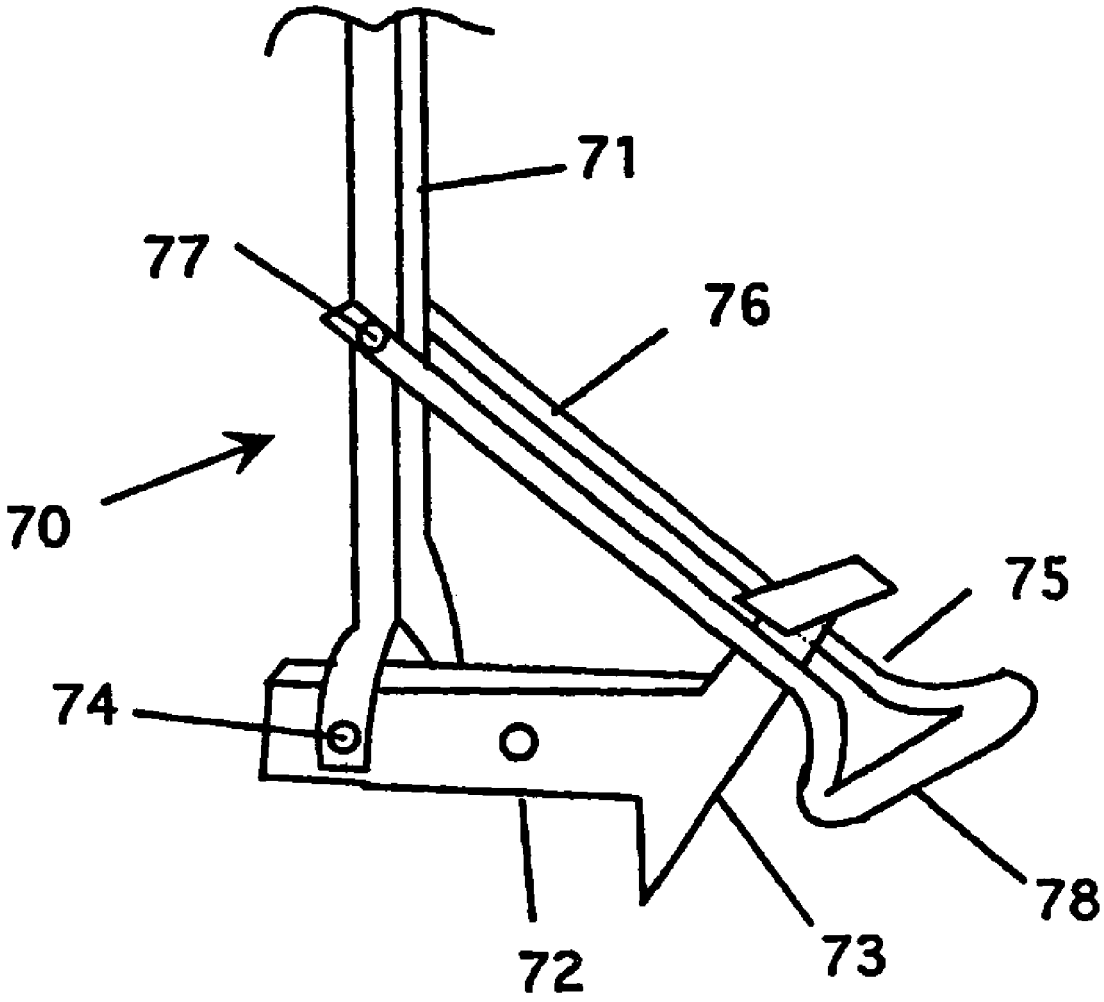
FIG. 13 is a perspective view of a fourth embodiment.

FIG. 13 shows a fourth embodiment 70. In this embodiment, the handle 71 is bifurcated as in the first embodiment. The spur bar 72 and spur 73 are also the same as before. The spur bar is attached to the handle 71 by a pivot 74. The main difference in this embodiment is the push bar 75. Here, the shoe is omitted. The push par is a formed piece of material that has a pair of arms 76 that attach to the handle at pivot 77. The nose 78 of the push bar is widened out as shown. This wide portion acts as a shoe to press against a board. The rear and front stops operate as discussed above for the first embodiment.

Figure 14:
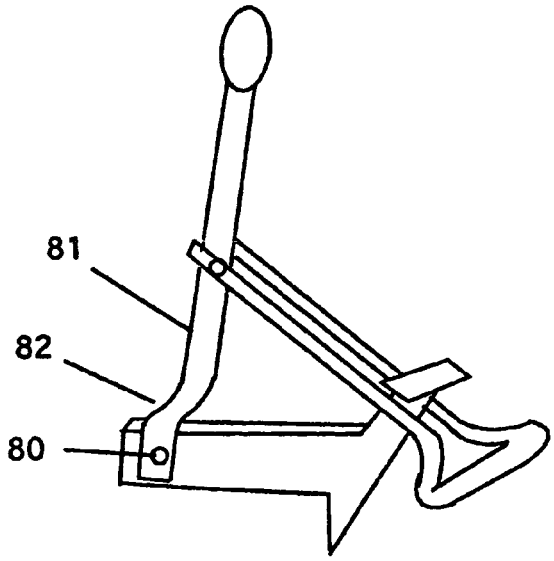
FIG. 14 is a perspective view of a fifth embodiment.

FIG. 14 shows a variation of the fourth embodiment 70. In this embodiment, the handle 81 is not bifurcated. Rather, it is a flat bar that is bent at an offset 82. The offset fits around the top of the spur bar. This offset allows the back of the spur bar to act as a rear stop. The bent portion of the handle 81 makes contact with the back of the spur bar. The front stop is the top of the spur, as in the other embodiments. The handle is held in place with a pivot 80 as before.

Figure 15:
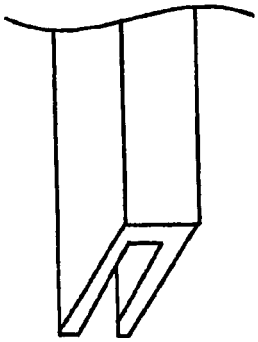
FIG. 15 is an enlarged detail view of an alternative spur construction.
Figure 16:
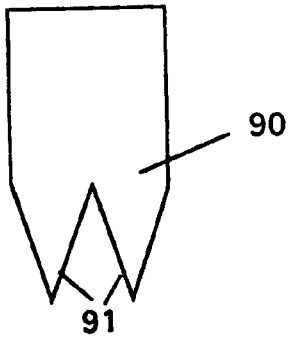
FIG. 16 is an enlarged detail view of a second alternative spur construction.
Figure 17:
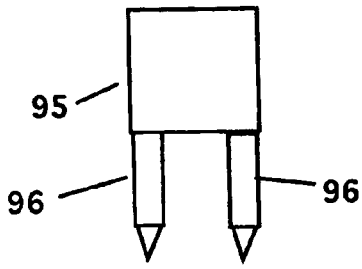
FIG. 17 is an enlarged detail view of a third alternative spur construction.

FIG. 15 shows a view of the bottom of one alternative spur 88. In this view, the spur is bifurcated, producing two points 89. FIG. 16 shows a view of the bottom of another alternative spur 90. In this view, the spur 90 has two teeth 91 as shown. FIG. 17 shows yet another alternative for the spur. In this view, the spur 95 has two spikes 96 that extend down from the spur body.

Many other configurations of teeth and spikes can be used. These are not preferred because they increase the cost and complexity of the device with little corresponding benefit.

Figure 18:
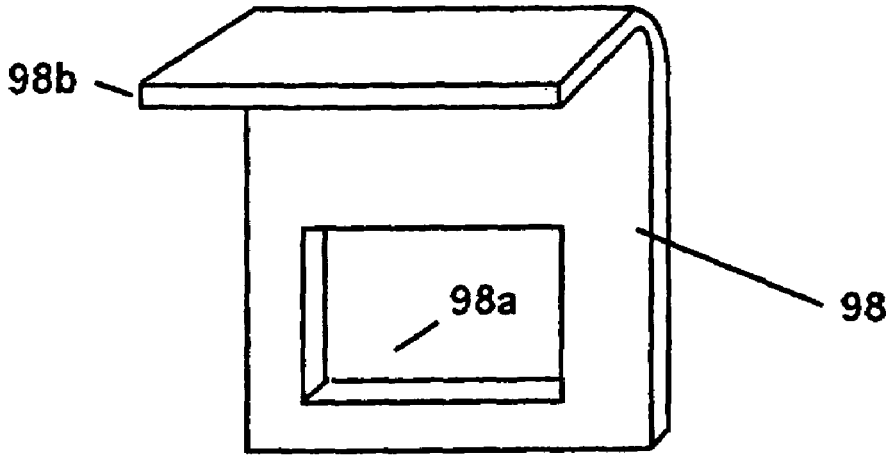
FIG. 18 is a perspective view of the sliding member for locking the device.
Figure 19:
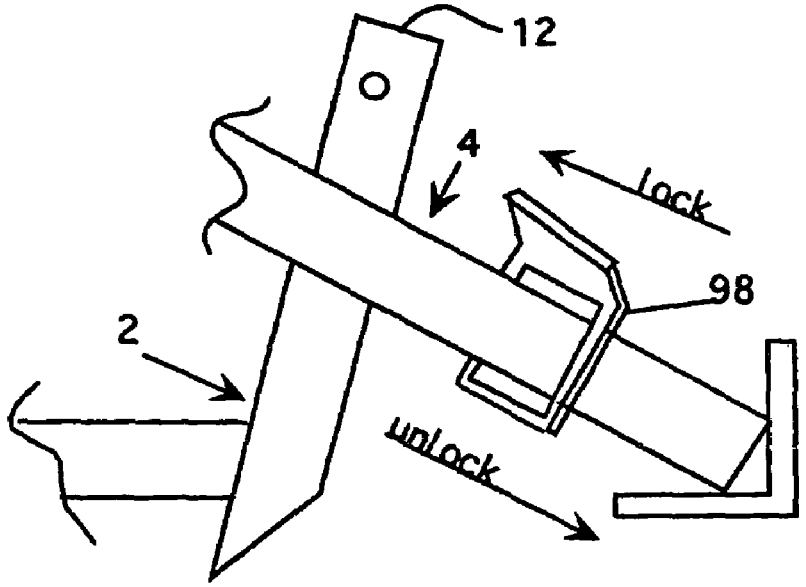
FIG. 19 is a detail view of the sliding member in place on the push arm.

FIGS. 18 and 19 show details of a locking mechanism, which can be added as well. The purpose of the locking mechanism is simple. Once a plank has been straightened, it must be fastened down to retain that position. Under certain circumstances, if the device cannot be locked the plank may move back into its warped position when the handle is released. The locking system eliminates this possibility. FIGS. 18 and 19 show details of the preferred locking system. In FIG. 18 a sliding member 98 is shown. This member is generally rectangular and has an open center 98*a* and a bent top lip 98*b*. FIG. 19 shows the sliding member in place on the push arm 4 as shown. To use the lock, once the plank is in the proper position. The sliding member is pushed up against the spur head 12 (see the direction of the arrow marked lock in FIG. 19) until it pinches between the push arm and the spur head. The sliding member then holds the device in the temporarily fixed position until the lock is released by pushing it in the opposite direction (see the arrow marked unlock in FIG. 19).

This locking method is preferred because it is used on the preferred embodiment. Also, because it is easy to manufacture and use. Other locking systems may be used, but these are not preferred. For example, a ratchet system, similar to that shown in U.S. Pat. No. 764,128. Such systems are well known in the art, but increase the cost of manufacture. Another lock can be a simple hole formed in the bottom of the shoe. The hole can be used to hold a nail or screw, which will hold the shoe in place until the board can be secured. Although this works, it is not preferred because it requires the extra steps of nailing or screwing a fastener in place and then removing it. Finally, it is also possible to use a cam type lock or a wing nut to tighten the push arm pivot point at the handle connection. Although this is easy to operate, it does take slightly more time than the slide lock and also increases the cost of manufacture of the device.

Figure 20:
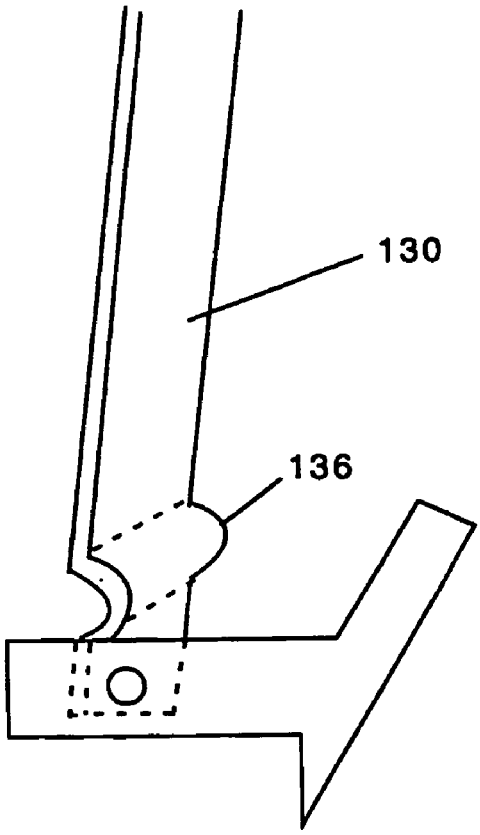
FIG. 20 is another alternative handle design.
Figure 21:
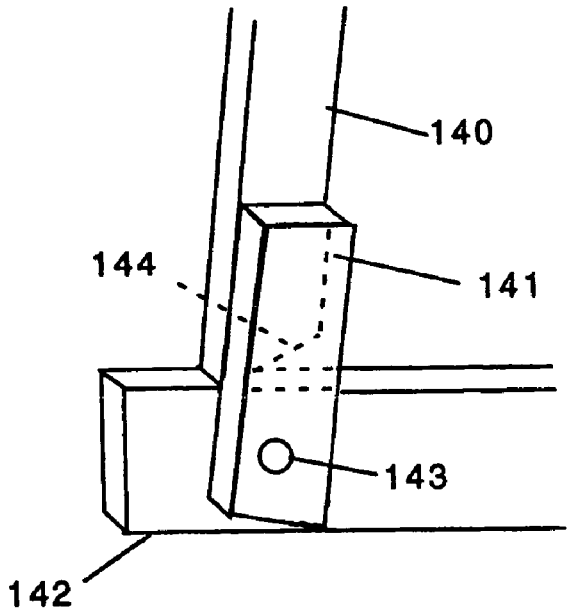
FIG. 21 is yet another alternative handle design.

FIGS. 20 and 21 show views of other alternative handle designs. FIG. 20 shows a handle 130 that has a bent portion 131 near its base. FIG. 21 shows an alternative handle design in which the handle 140 has an auxiliary support 141 that is welded or otherwise attached to the bottom of the handle 140. The auxiliary support 141 is attached to the spur bar 142 by a pivot pin 143. Note that the bottom 144 of the handle 140 is angled, as in the first embodiment, to allow for full movement of the handle.

Figure 2:
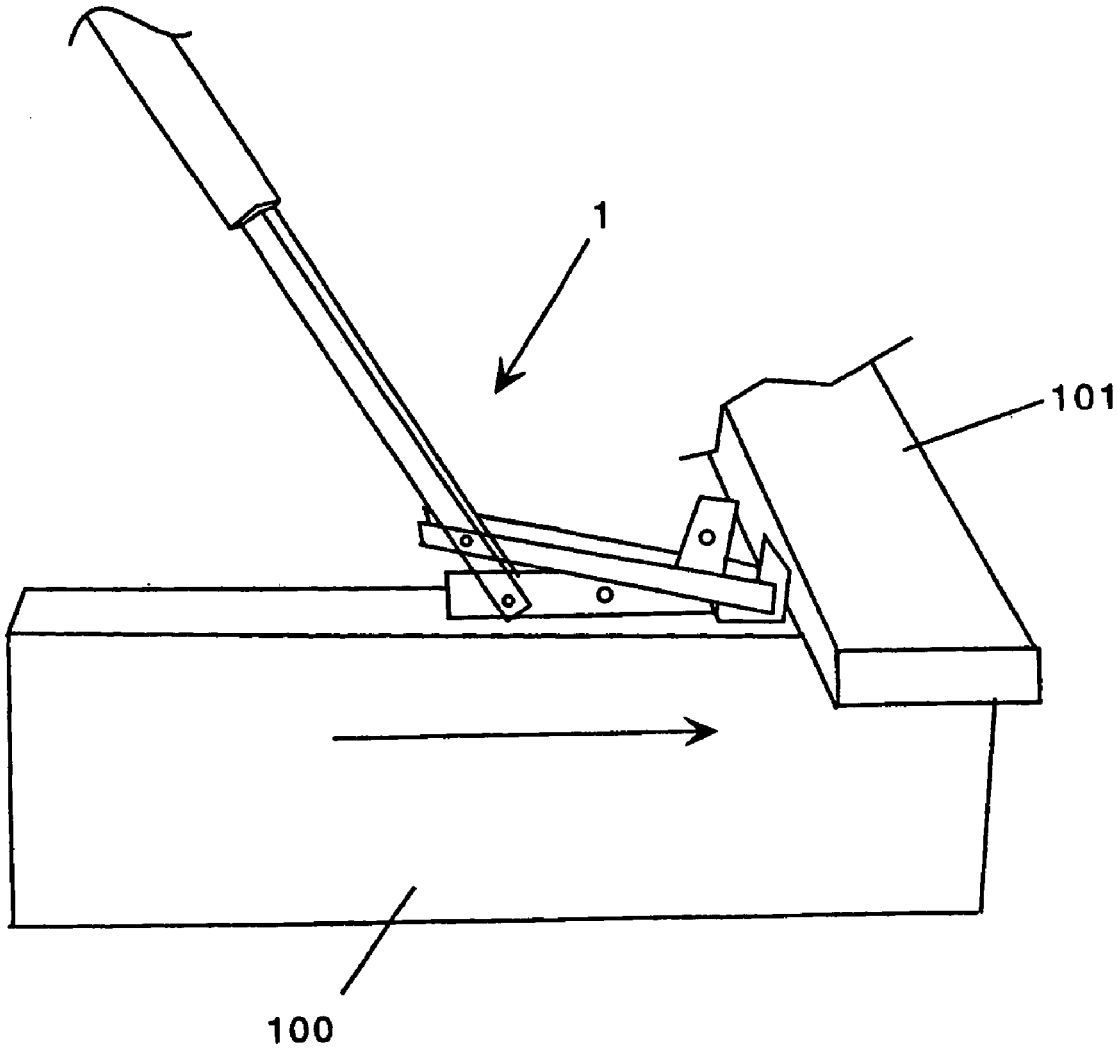
FIG. 2 is a detail view of the invention with the spur driven into the joist and a board in place, ready for straightening.
Figure 3:
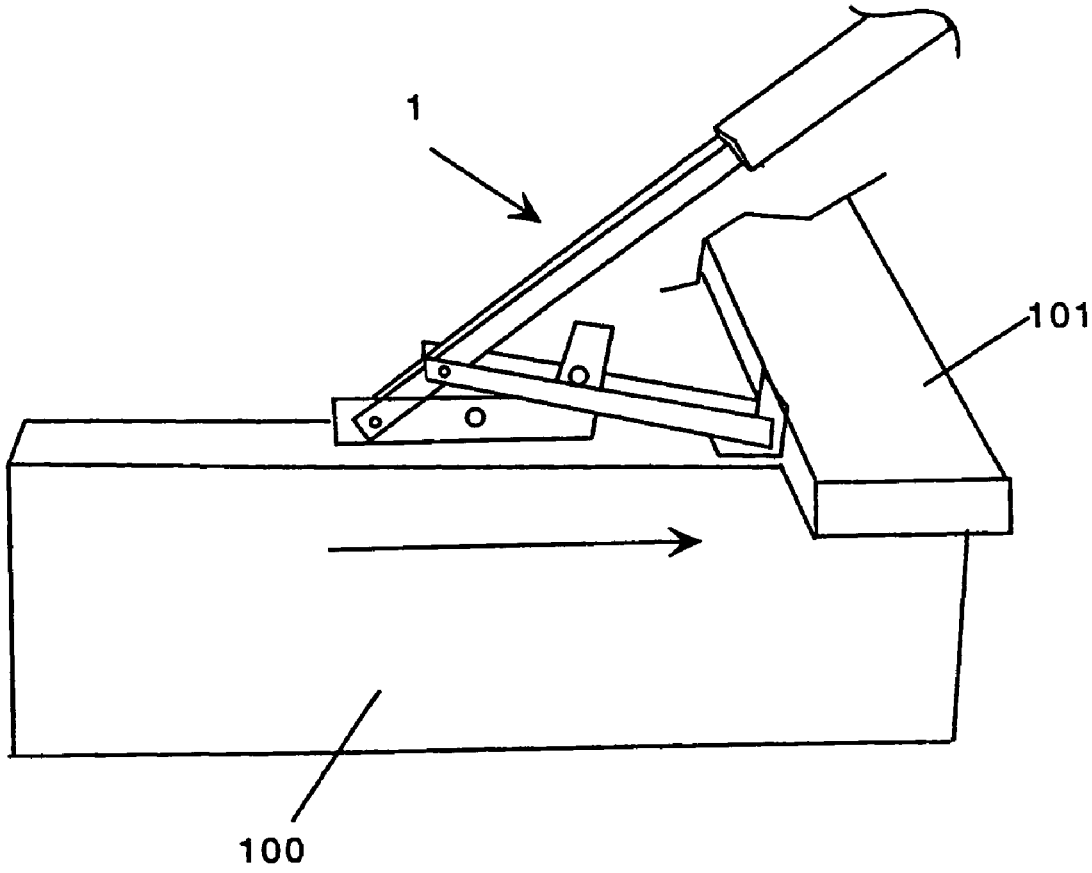
FIG. 3 is detail view of the invention with the spur driven into the joist and the handle advanced, with the device pushing against a board straightening it.

Referring now to FIGS. 1–3, the operation of the device is shown. FIG. 1 shows the device in position on a length of joist 100. The spur 14 is above the joist. A hammer or other implement is used to hit the spur head 12 to drive the spur 14 into the joist. FIG. 2 shows the device ready for use. Here, the device is set against a board 101 that needs to be straightened. The handle is pulled back until it stops against the spur bar. The spur can then be driven into the joist 100 below. This is what is shown in FIG. 2. To straighten the board 101, the handle is pulled forward. FIG. 3 shows this action. As shown, the shoe is moved forward some distance from the spur and its position in FIG. 2. Because the spur is driven into the joist, the shoe forces the board 101 to bed in the direction of the handle movement (as signified by the arrow). The user pulls the handle until the board 101 is straight. The board 101 is then secured to the joists to hold it in place. Once the board 101 is secure, the device can be pulled up from the joist and relocated as needed for the next operation. As mentioned above, if the device has a locking mechanism, the locking mechanism is engaged once the board is straight. It is released after the board is secured in place.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

The invention claimed is:

1. A bending jack for placement on a support surface below the jack to push a wooden plank positioned forward of the jack, comprising:

a handle having a first end portion for grasping by a user and a second end portion;

a spur bar having a first end portion and a second end portion, the second end portion of the spur bar being pivotally attached to the second end portion of the handle;

a spur fixedly attached to the first end portion of the spur bar at a forward position spaced away from the pivotal attachment of the second end portion of the spur bar to the second end portion of the handle, the spur projecting in a downward first direction from the spur bar for engagement with the support surface;

a spur head member fixedly attached to the first end portion of the spur bar and projecting in an upward second direction from the spur bar, the spur head member having a spur head portion positioned above and away from the spur bar for applying a downward driving force thereto to drive the spur into engagement with the support surface;

a push arm having a first end portion and a second end portion, the second end portion of the push arm being pivotally attached to the second end portion of the handle and the first end portion being positioned forward of the spur, a portion of the push arm adjacent to the spur head member being positioned below the spur head portion such that the spur head portion can be engaged for driving the spur into engagement with the support surface without interference by the push arm; and a push head fixedly and rigidly attached to the first end portion of the push arm and being positioned forward of the spur for engaging and pushing on the wooden plank.

2. The bending jack of claim 1 wherein the push arm and push head are of one-piece construction.

3. The bending jack of claim 1 further including a first stop fixedly attached to the spur head member above the push arm and positioned to engage and limit upward travel of the push arm relative to the spur bar.

4. The bending jack of claim 3 further including a second stop fixedly attached to the spur bar below the push arm and positioned to engage and limit downward travel of the push arm relative to the spur bar.

5. The bending jack of claim 1 wherein the push arm includes elongated spaced apart first and second push arm members defining a space therebetween, the first and second push arm members each having a first end portion and a second end portion, the second end portion of both of the first and second push arm members being pivotally attached to the second end portion of the handle, the push head spanning between and being fixedly and rigidly attached to the first end portions of both of the first and second push arm members.

6. The bending jack of claim 5 wherein the spur bar is positioned at least partially in the space between the first and second push arm members to guide and limit lateral movement of the spur bar.

7. The bending jack of claim 6 further including a first stop fixedly attached to the spur head member above and in position to engage at least one of the first and second push arm members and thereby limit upward travel of the first and second push arm members relative to the spur bar.

8. The bending jack of claim 7 further including a second stop fixedly attached to the spur bar below and in position to engage at least one of the first and second push arm members and thereby limit downward travel of the first and second push arm members relative to the spur bar.

9. The bending jack of claim 5 wherein the first and second push arm members and the push head are of one-piece construction.

10. The bending jack of claim 1 further including a cam lock member having an aperture, the push arm projecting through the aperture of the cam lock member and the cam lock member being selectively slidable along the push arm for movement of the cam lock member to a selected lock position along the push arm, the cam lock member being sized and positioned such that when in the selected lock position the cam lock member engages the forward end portion of the spur bar, the aperture of the cam lock member being sufficiently larger than the push arm to permit the cam lock member to be selectively rocked forward and rearward on the push arm to be move into and out of a locked condition, when in the locked condition and in the selected lock position the cam lock member prevents rearward movement of the push arm relative to the spur bar.

11. The bending jack of claim 10 wherein the cam lock member includes a flange attached thereto and projecting rearward in position to engage the forward end portion of the spur bar to apply a rocking force to the cam lock member and thereby maintain the cam lock member rocked on the push arm in the locked condition.

12. The bending jack of claim 10 wherein the cam lock member includes a lock edge defining an inward edge portion of the aperture of the cam lock member positioned to engage and grip the push bar when the cam lock member is rocked into the locked condition and thereby prevent rearward movement of the push bar relative to the spur bar.

13. A bending jack for placement against a support member to push a wooden plank, comprising:

a handle having a first end portion and a second end portion;

a spur bar having a first end portion and a second end portion, the second end portion of the spur bar being pivotally attached to the second end portion of the handle;

a spur attached to the first end portion of the spur bar and projecting in a first direction from the spur bar on a side of the spur bar toward the support member when the jack is in use for engagement with the support member;

a push arm having a first end portion and a second end portion, the second end portion of the push arm being pivotally attached to the second end portion of the handle and the first end portion of the push arm being positioned for pushing engagement with the wooden plank when the jack is in use; and a spur head member having a first end portion and a second end portion, the first end portion of the spur head member being attached to the first end portion of the spur bar, the spur head member projecting in a second direction from the spur bar on a side of the spur bar away from the support member when the jack is in use and beyond the push arm and terminating in the second end portion of the spur head member being positioned on a side of the push arm opposite the support member when the jack is in use and spaced away from the push arm for unobstructed application of a force to the second end portion of the spur head member to drive the spur into engagement with the support member without interference by the push arm.

14. The bending jack of claim 13 for use with a hammer to drive the spur into engagement with the support member, wherein the second end portion of the spur head member has a spur head portion adapted for striking with the hammer from a position in the second direction spaced away from the spur head portion.

15. The bending jack of claim 13 wherein the first end portion of the push arm has a push head portion attached thereto positioned beyond the first end portion of the spur bar so as to be spaced away from the spur in a direction toward the wooden plank for pushing engagement with the wooden plank when the jack is in use.

16. The bending jack of claim 15 wherein the push arm includes an elongated arm portion extending between the first and second end portions of the push arm, and the arm portion and push head portion are of one-piece construction.

17. The bending jack of claim 15 wherein the push arm includes an elongated arm portion extending between the first and second end portions of the push arm, and the push head portion is rigidly supported by the arm portion to prevent movement of the push head portion relative to the arm portion when the jack is in use.

18. The bending jack of claim 13 wherein the push arm includes elongated spaced apart first and second push arm members defining a space therebetween, the first and second push arm members each having a first end portion and a second end portion, the second end portion of both of the first and second push arm members being pivotally attached to the second end portion of the handle, and wherein the first end portions of the first and second push arm members have a push head member spanning therebetween and positioned for pushing engagement with the wooden plank when the jack is in use.

19. The bending jack of claim 18 wherein the push head member is rigidly attached to the first end portions of both of the first and second push arm members.

20. The bending jack of claim 19 wherein the first and second push arm members and the push head member are of one-piece construction.

21. The bending jack of claim 18 wherein the spur bar is positioned at least partially within the space between the first and second push arm members, the first and second push arm members being arranged to guide and limit lateral movement of the spur bar when the jack is in use.

22. The bending jack of claim 18 further including a first stop in a position to engage at least one of the first and second push arm members and thereby limit travel of the first and second push arm members in the second direction from the spur bar prior to when the jack is in use.

23. The bending jack of claim 22 further including a second stop in a position to engage at least one of the first and second push arm members and thereby limit travel of the first and second push arm members in the first direction from the spur bar prior to when the jack is in use.

24. The bending jack of claim 13 further including a first stop in a position to engage the push arm and thereby limit travel thereof in the second direction from the spur bar prior to when the jack is in use.

25. The bending jack of claim 24 further including a second stop in a position to engage the push arm and thereby limit travel thereof in the first direction from the spur bar prior to when the jack is in use.

26. The bending jack of claim 13 further including a lock member slidably attached to the push arm for slidable adjusting movement between the first end portion of the spur arm and the first end portion of the push arm, the lock member being selectively slidable along the push arm to a selected lock position along the push arm, the lock member being sized and positioned to engage the first end portion of the spur arm when in the selected lock position, the lock member being selectively rotatable on the push arm into a locked condition with the lock member in locking engagement with the push arm to prevent further sliding movement of the lock member toward the first end portion of the push arm and thereby prevent relative movement of the first end portion of the push arm toward the first end portion of the spur arm.

27. The bending jack of claim 26 wherein the lock member has an aperture and the push arm projects through the aperture to permit the lock member to be selectively slidable along the push arm, the aperture being sufficiently large to permit the lock member to be selectively rotated in opposing directions on the push arm and thereby moved into and out of the locked condition.

28. The bending jack of claim 26 wherein the lock member is selectively rotatable on the push arm into the locked condition about an axis transverse to the push arm.

29. The bending jack of claim 26 wherein the lock member includes a flange attached thereto and projecting toward the first end portion of the spur bar to apply a rotational force to the lock member to maintain the lock member rotated on the push arm in the locked condition.

30. A bending jack for placement against a support member to push a wooden plank, comprising:

a handle having a first end portion and a second end portion and arranged for rotation through a central plane;

a spur bar having a first end portion and a second end portion, the second end portion of the spur bar being pivotally attached to the second end portion of the handle for rotation through the central plane;

a spur located in the central plane and attached to the first end portion of the spur bar and projecting in a first direction in the central plane from the spur bar on a side of the spur bar toward the support member when the jack is in use for engagement with the support member;

a push arm having a first end portion and a second end portion, the second end portion of the push arm being pivotally attached to the second end portion of the handle for rotation through the central plane, the first end portion of the push arm being positioned for pushing engagement with the wooden plank when the jack is in use with a wooden plank arranged transverse to the central plane to apply a substantially balance pushing force on the portions of the wooden plank to each side of the central plane; and a spur head member located in the central plane and having a first end portion and a second end portion, the first end portion of the spur head member being attached to the first end portion of the spur bar, the spur head member projecting in a second direction in the central plane from the spur bar on a side of the spur bar away from the support member when the jack is in use and beyond the push arm and terminating in the second end portion of the spur head member being positioned in the central plane on a side of the push arm opposite the support member when the jack is in use and spaced away from the push arm for unobstructed application of a force generally in the central plane to the second end portion of the spur head member to drive the spur into engagement with the support member without interference by the push arm.

31. The bending jack of claim 30 wherein the push arm includes an elongated arm portion extending between the first and second end portions of the push arm, and the push head portion is rigidly supported by the arm portion to prevent movement of the push head portion relative to the arm portion when the jack is in use.

32. The bending jack of claim 30 wherein the push arm includes elongated spaced apart first and second push arm members, each positioned to an opposite side of the central plane and defining a space therebetween coincident with the central plane, the first and second push arm members each having a first end portion and a second end portion, the second end portion of both of the first and second push arm members being pivotally attached to the second end portion of the handle and arranged for rotation through the central plane, and wherein the first end portions of the first and second push arm members have a push head member spanning therebetween and positioned for pushing engagement with the wooden plank when the jack is in use.

33. The bending jack of claim 32 wherein the spur bar extends at least partially within the space between the first and second push arm members, the first and second push arm members being arranged to limit lateral movement of the spur bar when the jack is in use.

34. The bending jack of claim 33 further including a stop in a position to engage at least one of the first and second push arm members and thereby limit rotation of the first and second push arm members through the central plane in the second direction from the spur bar prior to when the jack is in use.

35. The bending jack of claim 30 further including a stop in a position to engage the push arm and thereby limit rotation thereof through the central plane in the second direction from the spur bar prior to when the jack is in use.

36. The bending jack of claim 30 further including a lock member slidably attached to the push arm for slidable adjusting movement between the first end portion of the spur bar and the first end portion of the push arms, the lock member being selectively slidable along the push arm to a selected lock position along the push arm, the lock member being sized and positioned to engage the first end portion of the spur bar when in the selected lock position, the lock member being selectively rotatable on the push arm into a locked condition with the lock member in locking engagement with the push arm to prevent further sliding movement of the lock member toward the first end portion of the push arm and thereby prevent relative movement of the first end portion of the push arm toward the first end portion of the spur bar.

37. The bending jack of claim 36 wherein the lock member has an aperture and the push arm projects through the aperture to permit the lock member to be selectively slidable along the push arm, the aperture being sufficiently large to permit the lock member to be selectively rotated in opposing directions on the push arm and thereby moved into and out of the locked condition.

38. The bending jack of claim 36 wherein the lock member includes a cam member attached thereto and projecting toward the first end portion of the spur bar to apply a rotational force to the lock member to maintain the lock member rotated on the push arm in the locked condition.

39. A bending jack for placement against a support member to push a wooden plank, comprising:

a handle having a first end portion and a second end portion;

spur bar having a first end portion and a second end portion, the second end portion of the spur bar being pivotally attached to the second end portion of the handle;

an spur attached to the first end portion of the spur bar for anchoring the jack to the support member when the jack is in use;

a push arm having a first end portion and a second end portion, the second end portion of the push arm being pivotally attached to the second end portion of the handle and the first end portion of the push arm being positioned for pushing engagement with the wooden plank when the jack is in use; and a spur head member having a first end portion and a second end portion, the first end portion of the spur head member being attached to the first end portion of the spur bar, the spur head member projecting from the spur bar on a side of the spur bar away from the support member when the jack is in use and beyond the push arm and terminating in the second end portion of the spur head member being positioned on a side of the push arm opposite the support member when the jack is in use and spaced away from the push arm for unobstructed application of a force to the second end portion of the spur head member to drive the spur into engagement with the support member without interference by the push arm.

40. The bending jack of claim 39 for use with a hammer to drive the spur into engagement with the support member, wherein the second end portion of the spur head member has a head portion adapted for striking with the hammer.

41. The bending jack of claim 39 wherein the first end portion of the push arm has a push head portion attached thereto positioned for pushing engagement with the wooden plank when the jack is in use, the push arm including an elongated arm portion extending between the first and second end portions of the push arm, the push head portion being rigidly supported by the arm portion to prevent movement of the push head portion relative to the arm portion when the jack is in use.

42. The bending jack of claim 39 wherein the push arm includes elongated spaced apart first and second push arm members defining a space therebetween, the first and second push arm members each having a first end portion and a second end portion, the second end portion of both of the first and second push arm members being pivotally attached to the second end portion of the handle, and wherein the first end portions of the first and second push arm members have a push head member spanning therebetween and positioned for pushing engagement with the wooden plank when the jack is in use.

43. The bending jack of claim 42 wherein the spur bar is positioned at least partially within the space between the first and second push arm members, the first and second push arm members being arranged to guide and limit lateral movement of the spur when the jack is in use.

44. The bending jack of claim 39 further including a stop in a position to engage the push arm members and thereby limit travel thereof in the direction of the second end portion of the spur head member prior to when the jack is in use.

45. The bending jack of claim 39 further including a lock member slidably attached to the push arm for slidable adjusting movement between the first end portion of the spur bar and the first end portion of the push arm, the lock member being selectively slidable along the push arm to a selected lock position along the push arm, the lock member being sized and positioned to engage the first end portion of the spur bar when in the selected lock position, the lock member being selectively rotatable on the push arm into a locked condition with the lock member in locking engagement with the push arm to prevent further sliding movement of the lock member toward the first end portion of the push arm and thereby prevent relative movement of the first end portion of the push arm toward the first end portion of the spur bar.

46. The bending jack of claim 45 wherein the lock member has an aperture and the push arm projects through the aperture to permit the lock member to be selectively slidable along the push arm, the aperture being sufficiently large to permit the lock member to be selectively rotated in opposing directions on the push arm and thereby moved into and out of the locked condition.

47. The bending jack of claim 45 wherein the lock member includes a cam member attached thereto and projecting toward the first end portion of the spur bar to apply a rotational force to the lock member to maintain the lock member rotated on the push arm in the locked condition.

48. A bending jack for placement against a support member to push a wooden plank, comprising:

a handle having a first end portion and a second end portion;

a spur bar having a first end portion and a second end portion, the second end portion of the spur bar being pivotally attached to the second end portion of the handle, the spur bar having a head portion positioned for application of a driving force thereto;

a spur attached to the first end portion of the spur bar and projecting in a direction from the spur bar on a side of the spur bar toward the support member when the jack is in use for engagement with the support member upon application of the driving force to the head portion of the spur bar; and a push arm having elongated spaced apart first and second push arm members and a push head member, the first and second push arm members defining a space therebetween and each having a first end portion and a second end portion, the second end portion of both of the first and second push arm members being pivotally attached to the second end portion of the handle, the push head member spanning between the first end portions of the first and second push arm members and positioned for pushing engagement with the wooden plank when the jack is in use, the spur bar being positioned at least partially within the space between the first and second push arm members, and the first and second push arm members being arranged to guide and limit lateral movement of the spur bar when the jack is in use.

49. The bending jack of claim 48 wherein the push head member is positioned beyond the first end portion of the spur bar so as to be spaced away from the spur in a direction toward the wooden plank for pushing engagement with the wooden plank when the jack is in use.

50. The bending jack of claim 48 wherein the first and second push arm members and the push head member are of one-piece construction.

51. The bending jack of claim 48 wherein the push head member is rigidly supported by the first and second push arm members to prevent movement of the push head member relative to the first and second push arm members when the jack is in use.

52. The bending jack of claim 48 further including a first stop in a position to engage at least one of the first and second push arm members and thereby limit travel of the first and second push arm members relative to the spur bar prior to when the jack is in use.

53. The bending jack of claim 48 further including a lock member slidably attached to the push arm for slidable adjusting movement between the first end portion of the spur bar and the push head member, the lock member being selectively slidable along the push arm to a selected lock position along the push arm, the lock member being sized and positioned to engage the first end portion of the spur bar when in the selected lock position, the lock member being selectively rotatable on the push arm into a locked condition with the lock member in locking engagement with the push arm to prevent further sliding movement of the lock member toward the push head member and thereby prevent relative movement of the push head member toward the first end portion of the spur bar.

54. The bending jack of claim 53 wherein the lock member has an aperture and at least one of the first and second push arm members projects through the aperture to permit the lock member to be selectively slidable thereal-ong, the aperture being sufficiently large to permit the lock member to be selectively rotated in opposing directions on the push arm and thereby moved into and out of the locked condition.

* * * * *